US011856987B2

(12) United States Patent
Pasternack

(10) Patent No.: US 11,856,987 B2
(45) **Date of Patent: *Jan. 2, 2024**

(54) ELECTRONIC DEVICE EMPLOYING MULTIPLE CARTRIDGES

(71) Applicant: Alex Pasternack, Los Angeles, CA (US)

(72) Inventor: Alex Pasternack, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/071,487

(22) Filed: Nov. 29, 2022

(65) Prior Publication Data

US 2023/0093650 A1 Mar. 23, 2023

Related U.S. Application Data

(63) Continuation of application No. 16/792,688, filed on Feb. 17, 2020, now Pat. No. 11,540,561.

(51) Int. Cl.
*A24F 40/42* (2020.01)
*A24F 40/50* (2020.01)

(52) U.S. Cl.
CPC ..... *A24F 40/42* (2020.01); *A24F 40/50* (2020.01)

(58) Field of Classification Search
CPC ..... A24F 40/42
See application file for complete search history.

(56) References Cited

U.S. PATENT DOCUMENTS 11,540,561 B2 * 1/2023 Pasternack ..... A24F 40/42

* cited by examiner

*Primary Examiner* — Jean F Duverne
(74) *Attorney, Agent, or Firm* — Smyrski Law Group, A P.C.

(57) ABSTRACT

An apparatus is provided including a first cartridge with a first central passageway and a first reservoir with a first product. The first product heated within the first cartridge forms a first quantity of vapor. The apparatus further includes a second cartridge having a second central passageway axially aligned with the first central passageway when the second cartridge is connected to the first cartridge and a second reservoir having a second product. The second product heated within the second cartridge forms a second quantity of vapor that passes through the second central passageway. The apparatus also includes a mouthpiece connected to the first cartridge and configured to deliver a combination of the first and second quantities of vapor from the first central passageway to a user.

20 Claims, 4 Drawing Sheets

ELECTRONIC DEVICE EMPLOYING MULTIPLE CARTRIDGES

The present application is a continuation of co-pending U.S. patent application Ser. No. 16/792,688, entitled "Electronic Smoking Device Employing Multiple Cartridges," inventor Alex Pasternack, filed Feb. 17, 2020, the entirety of which is incorporated herein by reference.

BACKGROUND

I. Field

The present invention relates generally to smoking, and more particularly to devices usable to smoke multiple stores and/or types of smokable products.

II. Background

Smoking is enjoyed in many corners of modern society. In some circles, smoking alternatives to cigarettes have developed significant interest. Various plant materials and herbs are enjoyed by many Electronic smoking devices have been produced and are believed by some to provide certain advantages, with advantages mentioned including avoiding tobacco issues, including smoke impurities such as carbon monoxide, ash, and tar.

Various types of smoking devices are currently available. Certain people exhibit certain preferences for materials being consumed, and some users have elected to carry multiple smoking devices. For example, users sometimes have preferences for consuming THC products while at other times they prefer smoking herbs, cannabis, or different THC products.

No devices are known that address this issue, likely having to do with the complexity of providing two different products for smoking to a user as desired. No known product is unitary in design and offers the user the ability to smoke one material at one point and a different material at a different point, or smoking a combination of products without, for example, completely removing the first material from the device.

Additionally, certain users wish to consume a combination of products in a desired ratio or strength, such as a 50/50 ratio of THC product smoked with an alternative product or products, or a 90/10 ratio, or a 10/90 ratio. A user using currently available devices needs to mix the products in the desired ratio in a single cartridge and must alter the combination or ratios of product in the single cartridge if a change in strength is desired. Products enabling such combined product consumption, with an ability to dynamically alter the ratio of multiple products could provide certain benefits.

It would be beneficial to provide a device that quickly and efficiently provides a user with the ability to employ a single device for different types of smokable products or compositions. Such a design that overcomes issues with prior devices would be beneficial, and thus improve the user experience with such products.

SUMMARY

The following presents a simplified summary in order to provide a basic understanding of some aspects of the claimed subject matter. This summary is not an extensive overview and is not intended to identify key/critical elements or to delineate the scope of the claimed subject matter.

Its sole purpose is to present some concepts in a simplified form as a prelude to the more detailed description that is presented later.

According to an embodiment of the present design, there is provided an apparatus comprising a first cartridge comprising a first central passageway and a first reservoir comprising a first product, wherein the first product heated within the first cartridge forms a first quantity of vapor that passes through the first central passageway, a second cartridge comprising a second central passageway axially aligned with the first central passageway when the second cartridge is connected to the first cartridge, the second central passageway receiving the first quantity of vapor from the first central passageway, and a second reservoir comprising a second product, wherein the second product heated within the second cartridge forms a second quantity of vapor that combines with the first quantity of vapor and passes through the second central passageway. The apparatus further comprises a mouthpiece connected to the second cartridge and configured to receive a combination of the first quantity of vapor and the second quantity of vapor from the second central passageway and deliver the combination to a user.

According to another embodiment of the present design, there is provided an apparatus comprising a first upper cartridge comprising a first central passageway and a first reservoir comprising a first product heatable to form a first quantity of vapor that passes to and through the first central passageway. The first upper cartridge has a first end configured to attach to a second lower cartridge, the second lower cartridge comprising a second central passageway axially aligned with the first central passageway and a second reservoir comprising a second product. The second product heated within the second lower cartridge forms a second quantity of vapor that passes to and through the second central passageway and combines with the first quantity of smoke in the first central passageway. The first upper cartridge has a second end configured to attach to a mouthpiece configured to receive a combination of the first quantity of vapor and the second quantity of vapor from the first central passageway and deliver the combination to a user.

According to a further embodiment of the present design, there is provided an apparatus comprising an upper joint joinable to an upper cartridge comprising an upper cartridge passageway, a central passageway configured to fit with and provide gasses to the upper cartridge passageway, and a reservoir comprising a product. Heating the product forms a quantity of vapor that passes to and through the central passageway to the upper cartridge passageway when the upper joint is connected to the upper cartridge.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In this document, the words "embodiment," "variant," and similar expressions are used to refer to a particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

The present design comprises an apparatus usable for a user to consume different smokable products using a single device. The present device employs a first cartridge, or chamber, also known in vaping designs as a vape cart, as well as a coupler stacked vertically between a second cartridge and a battery. The coupler "pulls" a desired amount from the first chamber relative to an amount being pulled from the second chamber. A user can dynamically select a desired strength using the present design and coupler.

One fairly standard battery employed in vaping devices is a 510 battery, having in most cases 0.5 mm threading. The coupler in the present design is male-female, where the bottom of the coupler can screw into a 510 threaded battery, and the top of the coupler may match with different devices.

While described herein for use with various THC products, and in some instances, cannabis, herbs, or other organic products, it is to be understood that any type of smokable material, and particularly smokable liquid material, may be employed, including tobacco products.

Figure 1:
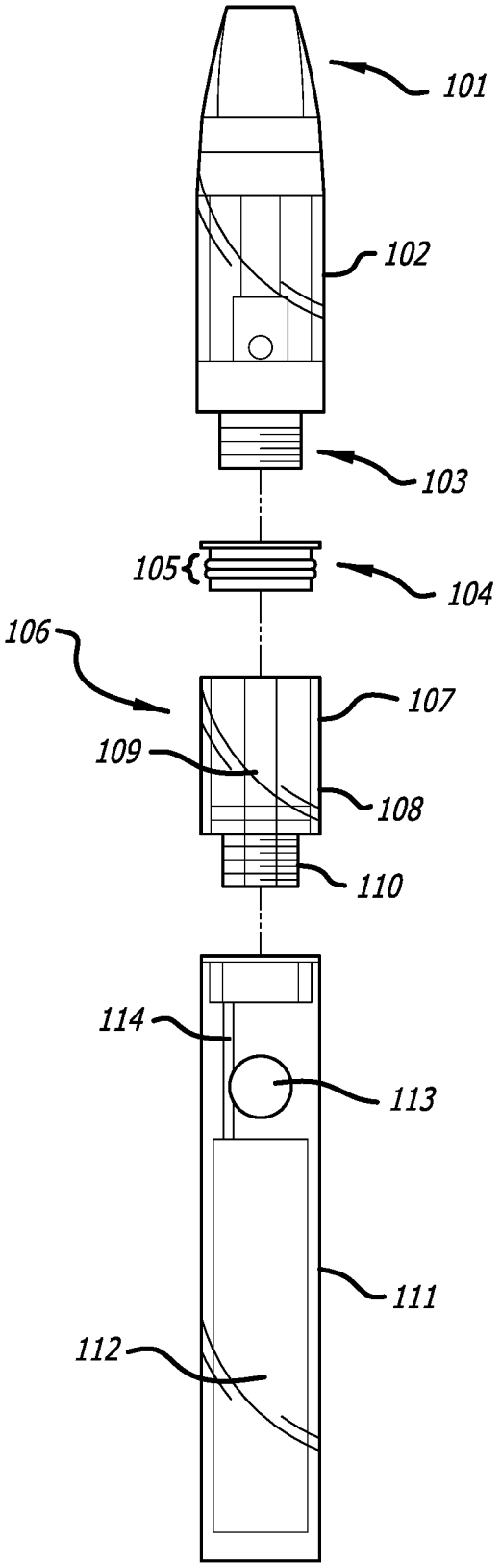
FIG. 1 illustrates an example of an electronic smoking device in accordance with the present design.

FIG. 1 illustrates a first representation of the present design. From FIG. 1, there is provided a mouthpiece 101 connected to a cartridge 102. The cartridge 102 may include or receive any appropriate material, including but not limited to CBD oil, nicotine vape juice, and so forth, and may be a standard 510 cartridge, i.e. a cartridge that employs standard 510 threading as discussed above. Cartridge 102 has male end 103 that may include a standard 510 thread. Cartridge 102 joins to mouthpiece 101 in any appropriate manner, such as by threaded joint or otherwise, such that material or gasses may pass from, for example, male end 103 to the tip of mouthpiece 101.

Connector 104 includes, at a top end in this view, female threads that allow screwing connector 104 to threads of male end 103 and attachment to cartridge 102. In this view, optional silicon seals 105 are provided to provide a tight seal without risk of material passing through the threads.

Second cartridge 106 is also shown, including a resin tank 107, a resistance coil or heater 108, and two air tubes 109 that conduct power and heat toward cartridge 102. The two tubes are typically concentric and allow for passthrough of power and heated material or gas. In this arrangement, both heating and gas from material in resin tank 107 in second cartridge 106 passes to cartridge 102, which in turn provides additional combustion of the material contained therein and allows for passage of smoke to mouthpiece 101 and to the user. The arrangement shown may allow for smoke or gasses made from the contents of both reservoirs, namely resin tank 107 and the reservoir in cartridge 102, to be received by the user.

Second cartridge 106 further includes male end 110, again in one embodiment comprising male 510 threads, configured to join second cartridge 106 to base 111. Base 111 includes battery 112 as a power source, on/off button 113 configured to apply power from battery 112 to resistance coil or heater 108 via wire or connection 114. Base 111 further includes female threads 115, used to join base 111 to second cartridge 106. Female threads 115 may be female 510 threads in one embodiment. Note that in this view not all parts or components are drawn to scale. In practice, the device may be assembled such that all components fit together tightly with no gaps between components.

Second cartridge 106 may contain material different from or identical to material provided in cartridge 102. The percentage of each material from each cartridge may be altered by the user, by for example putting different levels of material in each cartridge, or a system may be included that limits the amount of material passing to the central gas channel, such as closing or partially closing openings between the central passage and the reservoirs. Alternate heat levels may also be applied, such as significant heat to second cartridge 106 and much less heat to cartridge 102. Alternately, holes or openings may be provided that result in a known percentage of mixing between the gasses, i.e. a 50/50 division between components, or 60/40, or whatever may be desired. In certain instances, a given opening may be provided in one component, such as the cartridge 102 internal passageway, and varying second cartridges, such as second cartridge 106, may be provided with different sized openings therein. For example, an opening in a second cartridge may provide a 50/50 ratio of gasses when paired with a cartridge of known sized opening, while when paired with a different second cartridge having a smaller or larger opening or openings may result in a 90/10 or 10/90 or other ratio combination of material, smoke, or gas received. In all circumstances, the amount and strength of materials, smoke, or gasses provided to the user may be controlled by the user and may vary as desired. One of ordinary skill in the art understands and appreciates that words such as smoke, gas, gasses, vapor, and vapors are used interchangeably herein to represent resultant quantities, and use of these words in any context herein is not intended to be in any way limiting.

As may be appreciated, a typical device may include components similar to base 111, cartridge 102, and mouthpiece 101, assembled together, offering the user a single product for combustion and consumption.

Figure 2:
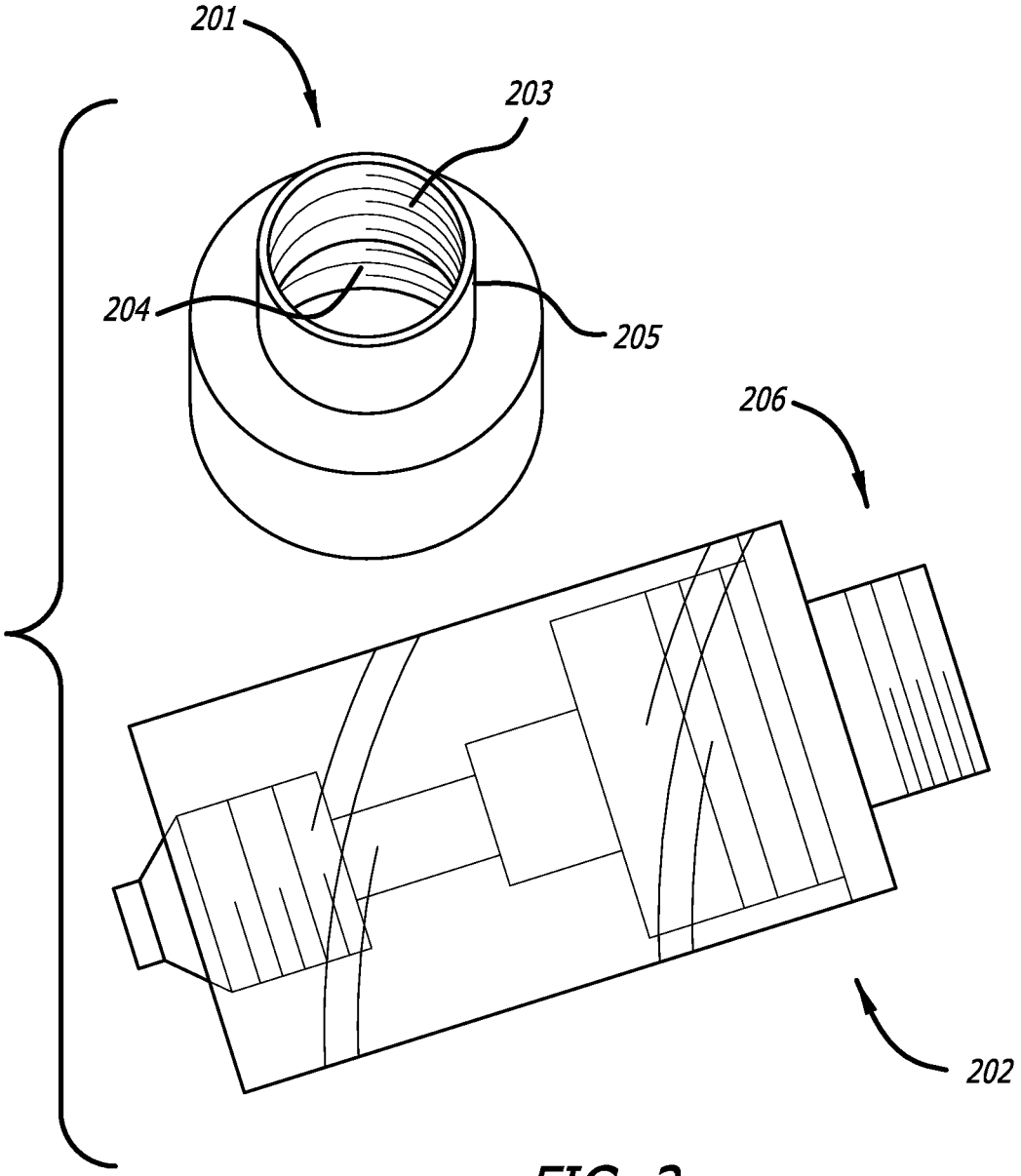
FIG. 2 is a representation of a connector and a second or lower cartridge in accordance with the present design.

A sample connector similar to connector 104 is shown in FIG. 2 as connector 201, together with a sample of a second cartridge 202, similar to second cartridge 106 in FIG. 1. Connector 201 includes upper threads 203 and lower threads 204, enabling joining with components above and below, as well as a central passage and an outer ring 205 that allows for the conduction of heat, providing heat to an adjoining cartridge or component. It may be appreciated that the components provided in FIG. 1 may be constructed of various materials, with components that facilitate heat conduction such as outer ring 205 being formed of metal or an alloy. Other components may be formed from available appropriate materials, including but not limited to plastics and plastic components as well as metals, alloys, and other compounds. The walls of second cartridge 202 in this representation are transparent and may be formed of a plastic or polymer, for example. Second cartridge 202 includes male end 206, used to adjoin to other parts as shown in FIG. 1, for example.

Figure 3:
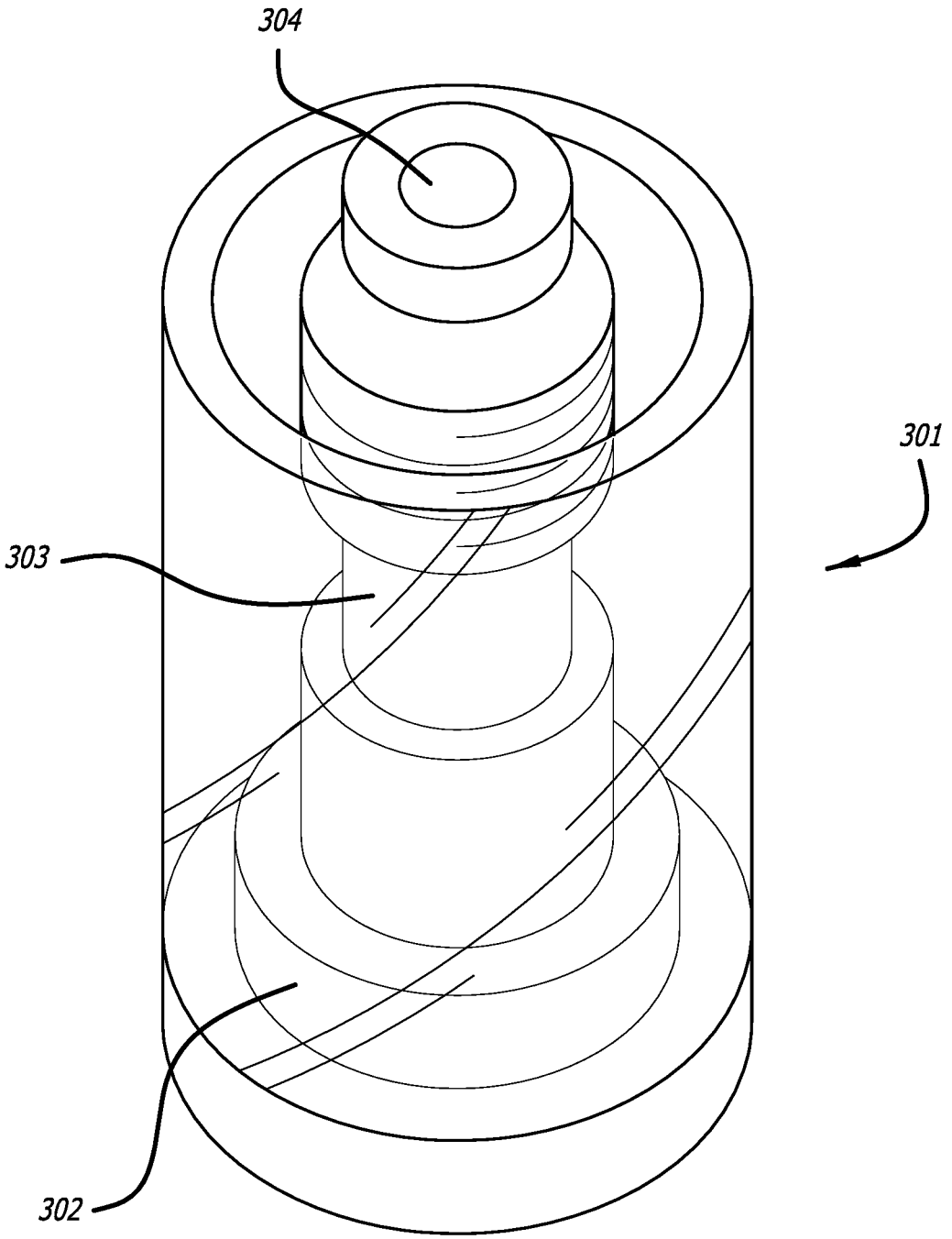
FIG. 3 illustrates an alternate view of an embodiment of a lower cartridge in accordance with one embodiment of the present design.

A further view of a sample second cartridge is provided in FIG. 3. From FIG. 3, second cartridge 301 includes resistance coil or heater 302 as well as central component 303 that serves to receive and heat resin contained in second cartridge 301 and a central passageway 304 that allows for delivery of gasses to further adjacent components, as well as ring 305 that serves to pass heat to adjacent components.

Figure 4:
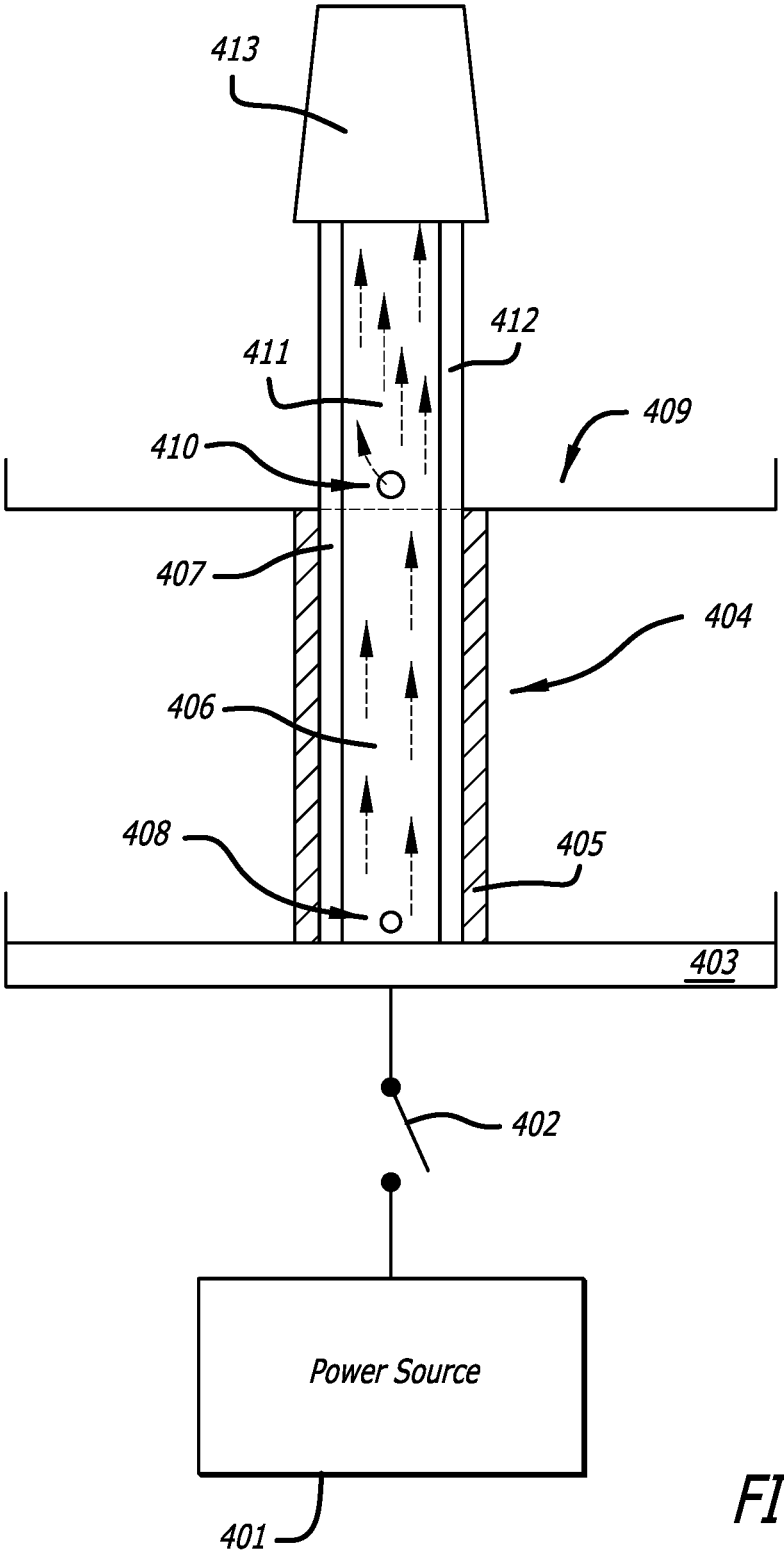
FIG. 4 is a general simple representation of certain components of the design facilitating an understanding of heat, electricity, and gas flow in the design.

FIG. 4 is a simplified drawing of the power, heat, and combustion employed according to the present design. FIG. 4 does not include several components of the design reflected in the other drawings of the present design, including walls or exterior surfaces and is primarily provided to facilitate an understanding of the construction and operation of several of the centermost elements of the present design. From FIG. 4, power source 401 is provided and switchable by switch 402 to apply power to heater 403, which may be relatively large and may heat product in the cartridge closest to power source 101, which when heated may pass through opening 408 and may take the form of smoke, passing upward in this representation through internal passage 406. In this embodiment, a dual layer passage is provided, including outer thermal layer 405 and inner passage layer 407. Typically, when two such layers are employed they each have different heat attributes, where heat propagates more readily through one layer than the other, such as more rapidly through the outer layer. Thus in this embodiment, outer thermal layer 405 passes heat from heater 403 more rapidly than inner passage layer 407.

The two dual layer passage components, outer thermal layer 405 and inner passage layer 407, contact base element 409 of an upper cartridge. Base element 409 may be on an exterior surface of an upper cartridge or may be located within the upper cartridge, and an intermediate coupler (not shown in this view) may be provided that conducts heat adequately. Base element 409 in turn operates to heat product in the upper cartridge and passes heated product through opening 410, combining with smoke from the lower components. In this embodiment, the upper cartridge includes a single layer passageway 412 including inner passage 411 allowing the passage of smoke and gasses, as no heat transfer is required. Single layer passageway 412 may be formed of the same or similar material as inner passage layer 407, or different materials may be used. The combined smoke or gasses then pass through inner passage 411 to mouthpiece 413 for consumption by the user. In one embodiment, the upper cartridge in this design, housing single layer passageway 411, may be a standard 510 cartridge known to those skilled in the art.

With respect to the specific components employed, it may be appreciated that electrical and heat coefficients may differ to provide a desired effect. For example, electrical resistance or resistances of the individual components may vary, such as a resistance of 0.8 ohms or some other value, and different lengths of components may be employed. A metal or alloy or material with a particular coefficient may be employed to effectuate the resultant smoke levels provided to the user. Also, while shown with two layers in FIG. 4 (outer thermal layer 405 and inner passage layer 407), a single layer may be employed where appropriate.

Other constructions may be employed, such as more than two cartridges, each with appropriate connectors, wherein different sized holes are employed to regulate amounts or strengths of product produced. In such a further cartridge construction, multiple layers (similar to outer thermal layer 405 and inner passage layer 407) may be employed in lower cartridges in an arrangement similar to FIG. 4, and a third or additional layer would typically not be required. Heating and electrical components may be provided to facilitate the accurate heating of product in such a multi-layer arrangement. For example, while depicted as a two layer passageway including one layer that advantageously conducts heat, one layer of a two layer arrangement may conduct electricity to a heating element in an upper cartridge, thereby allowing for heating of product in the upper cartridge in a desired manner.

Further, as discussed, any smokable product, preferably liquid, that is smokable may be employed in the current design, including but not limited to THC, cannabis, tobacco, herbal, or other plant or other products (e.g. psyllium) may be employed, without limitation, and as noted, multiple cartridges employing the same products may be used in accordance with the present design. One of ordinary skill in the art understands and appreciates that THC, CBD, cannabis, tobacco, herbal, or other plant or other products (e.g. psyllium) are used herein to represent source products, and use of these words in any context herein is not intended to be in any way limiting.

Note that as used herein, the term "passageway" has been generally used herein to represent the air or gas opening or passage through a cartridge or other hardware elements of the design. However, as used herein, the term "passageway" is not intended to be limiting and may represent the opening or passage within the device and/or may include the outer element or element, such as a tube or set of two concentric tubes or passage elements, such as concentric hardware tubes provided or a single tube, such as a metal tube. In other words, the term "passageway" may refer to the hardware forming the central opening or passage through the cartridge as well as the opening provided therein. Further, while cartridges are shown in the present design to be linearly arranged, other arrangements, including cartridges positioned side-by-side, may be employed in accordance with the present teachings.

According to an embodiment of the present design, there is provided an apparatus comprising a first cartridge comprising a first central passageway and a first reservoir comprising a first product, wherein the first product heated within the first cartridge forms a first quantity of vapor that passes through the first central passageway, a second cartridge comprising a second central passageway axially aligned with the first central passageway when the second cartridge is connected to the first cartridge, the second central passageway receiving the first quantity of vapor from the first central passageway, and a second reservoir comprising a second product, wherein the second product heated within the second cartridge forms a second quantity of vapor that combines with the first quantity of vapor and passes through the second central passageway. The apparatus further comprises a mouthpiece connected to the second cartridge and configured to receive a combination of the first quantity of vapor and the second quantity of vapor from the second central passageway and deliver the combination to a user.

According to another embodiment of the present design, there is provided an apparatus comprising a first upper cartridge comprising a first central passageway and a first reservoir comprising a first product heatable to form a first quantity of vapor that passes to and through the first central passageway. The first upper cartridge has a first end configured to attach to a second lower cartridge, the second lower cartridge comprising a second central passageway axially aligned with the first central passageway and a second reservoir comprising a second product. The second product heated within the second lower cartridge forms a second quantity of vapor that passes to and through the second central passageway and combines with the first quantity of smoke in the first central passageway. The first upper cartridge has a second end configured to attach to a mouthpiece configured to receive a combination of the first quantity of vapor and the second quantity of vapor from the first central passageway and deliver the combination to a user.

According to a further embodiment of the present design, there is provided an apparatus comprising an upper joint joinable to an upper cartridge comprising an upper cartridge passageway, a central passageway configured to fit with and provide gasses to the upper cartridge passageway, and a reservoir comprising a product. Heating the product forms a quantity of vapor that passes to and through the central passageway to the upper cartridge passageway when the upper joint is connected to the upper cartridge.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. An apparatus comprising:

a first cartridge comprising:

a first central passageway; and a first reservoir comprising a first product, wherein the first product heated within the first cartridge forms a first quantity of vapor that passes through the first central passageway;

a second cartridge comprising:

a second central passageway axially aligned with the first central passageway when the second cartridge is connected to the first cartridge, the second central passageway receiving the first quantity of vapor from the first central passageway; and a second reservoir comprising a second product, wherein the second product heated within the second cartridge forms a second quantity of vapor that combines with the first quantity of vapor and passes through the second central passageway; and a mouthpiece connected to the second cartridge and configured to receive a combination of the first quantity of vapor and the second quantity of vapor from the second central passageway and deliver the combination to a user.

2. The apparatus of claim 1, wherein the first product differs from the second product.

3. The apparatus of claim 1, wherein the first product is the same as the second product.

4. The apparatus of claim 1, further comprising a heating element, wherein the heating element heats at least a portion of the first central passageway which in turn provides heat to the second cartridge.

5. The apparatus of claim 4, further comprising a power source connected to the heating element.

6. The apparatus of claim 5, further comprising a switch configured to selectively provide power from the power source to the heating element.

7. The apparatus of claim 1, further comprising a selectively sized opening to the first central passageway, the selectively sized opening dimensioned relative to an opening of the second central passageway for controlling strength of the first quantity of vapor relative to the second quantity of vapor.

8. The apparatus of claim 1, wherein the first central passageway comprises a conduction element configured to advantageously conduct heat or electricity.

9. An apparatus comprising:

a first upper cartridge comprising:

a first central passageway; and a first reservoir comprising a first product heatable to form a first quantity of vapor that passes to and through the first central passageway;

wherein the first upper cartridge has a first end configured to attach to a second lower cartridge, the second lower cartridge comprising:

a second central passageway axially aligned with the first central passageway; and a second reservoir comprising a second product;

wherein the second product heated within the second lower cartridge forms a second quantity of vapor that passes to and through the second central passageway and combines with the first quantity of smoke in the first central passageway; and wherein the first upper cartridge has a second end configured to attach to a mouthpiece configured to receive a combination of the first quantity of vapor and the second quantity of vapor from the first central passageway and deliver the combination to a user.

10. The apparatus of claim 9, further comprising a connector located between the first upper cartridge and the second lower cartridge.

11. The apparatus of claim 9, further comprising a heating element, wherein the heating element heats at least a portion of the second central passageway which in turn provides heat to the first upper cartridge.

12. The apparatus of claim 11, further comprising a power source connected to the heating element.

13. The apparatus of claim 12, further comprising a switch configured to selectively provide power from the power source to the heating element.

14. The apparatus of claim 9, further comprising an opening to the first central passageway sized relative to an opening of the second central passageway to control strength of the first quantity of vapor relative to the second quantity of vapor.

15. The apparatus of claim 9, wherein the second central passageway comprises a conduction element configured to advantageously conduct heat or electricity within the apparatus.

16. An apparatus comprising:

an upper joint joinable to an upper cartridge comprising an upper cartridge passageway;

a central passageway configured to fit with and provide gasses to the upper cartridge passageway; and a reservoir comprising a product;

wherein heating the product forms a quantity of vapor that passes to and through the central passageway to the upper cartridge passageway when the upper joint is connected to the upper cartridge.

17. The apparatus of claim 16, wherein the heating element heats at least a portion of the central passageway which in turn provides heat to the upper cartridge.

18. The apparatus of claim 17, further comprising a lower joint securable to a device comprising a power source, wherein the power source is connected to a heating element when the lower joint is secured to the device.

19. The apparatus of claim 16, wherein the central passageway has an opening formed therein.

20. The apparatus of claim 16, wherein the central passageway comprises a conduction element configured to conduct heat or electricity to the upper cartridge.

* * * * *